US007287335B2

(12) United States Patent
Yasuda et al.

(10) Patent No.: US 7,287,335 B2
(45) Date of Patent: Oct. 30, 2007

(54) ARCHERY-SIGHT

(75) Inventors: Masaki Yasuda, Yokosuka (JP); Shinichi Umezawa, Hachioji (JP)

(73) Assignee: Yasui & Co., Tokyo (JP)

( * ) Notice: Subject to any disclaimer, the term of this patent is extended or adjusted under 35 U.S.C. 154(b) by 0 days.

(21) Appl. No.: 11/194,754

(22) Filed: Aug. 2, 2005

(65) Prior Publication Data

US 2006/0026848 A1 Feb. 9, 2006

Related U.S. Application Data

(60) Provisional application No. 60/599,057, filed on Aug. 6, 2004.

(51) Int. Cl.
*F41G 1/467* (2006.01)

(52) U.S. Cl. ..... 33/265

(58) Field of Classification Search ..... 33/265; 124/87

See application file for complete search history.

(56) References Cited

U.S. PATENT DOCUMENTS

| | | | | |
|---|---|---|---|---|
| 3,590,489 A | 7/1971 | Saunders | ..... | 33/46 A |
| 3,800,424 A | 4/1974 | Saunders et al. | ..... | 33/265 |
| 5,289,814 A | 3/1994 | Maisano | ..... | 124/87 |
| 6,477,779 B1 * | 11/2002 | Slates | ..... | 33/265 |

FOREIGN PATENT DOCUMENTS

| | | |
|---|---|---|
| GB | 1037715 A | 8/1966 |
| JP | 60-156703 U | 10/1985 |
| JP | 61-56901 A | 3/1986 |
| JP | 63-1917 U | 1/1988 |
| JP | 4-58620 U | 5/1992 |
| JP | 11-62956 A | 3/1999 |

OTHER PUBLICATIONS

Communication pursuant to Article 96(2) EPC dated Dec. 28, 2006, in counterpart European Patent Application No. 05 254 922.7-1260.

* cited by examiner

*Primary Examiner*—G. Bradley Bennett
(74) *Attorney, Agent, or Firm*—Kubovcik & Kubovcik

(57) ABSTRACT

The sight mounted to a bow portion for archery, which includes an elevation bar fixed to the bow portion and having a first sliding surface and a second sliding surface; a box mounted so as to be slidable along the first sliding surface and the second sliding surface of the elevation bar; an elastic member mounted to the box so as to be opposed to the first sliding surface; and a pressurizing device that pressurizes the elastic member in a direction at an angle with respect to the first sliding surface to deform the elastic member, the box being pressurized by the first sliding surface due to the elastic member and pressed against the second sliding surface. By the archery sight, it can solve the problem that a rattling is generated and leads to poor reproduction performance, resulting in rather poor usability for the athlete.

28 Claims, 6 Drawing Sheets

ARCHERY-SIGHT

This application claims the benefit of U.S. Provisional Application No. 60/599,057 filed Aug. 6, 2004.

BACKGROUND OF THE INVENTION

1. Field of the Invention

The present invention relates to a sight used as an archery equipment (hereinafter referred to as a "sight").

2. Related Background Art

As shown in FIG. 1, a bow 1 for use in archery is composed of a bow portion 1 and a string 2. The bow portion 1 is an arcuate plate-like member, to the ends of which the ends of the string 2 are respectively attached. When the string 2 is drawn, the distance between the ends of the bow portion 1 is reduced, and the bow rim is deflected. The deflection of the bow portion 1 causes elastic energy for shooting out an arrow to be accumulated in the bow portion 1. The string 2 transmits the elastic energy accumulated in the bow portion 1 to the arrow.

Further, a stabilizer 3 and a sight 4 are mounted to the bow portion 1 so as to extend forwards from the bow portion 1 respectively. The stabilizer 3 is mounted for the purpose of stabilizing the attitude of the bow and mitigating vibration, impact, etc. The sight 4 is mounted for the purpose of aiming the arrow to the target.

The sight 4 is a device which relates the line of sight of an athlete, the attitude of the bow portion 1 held by the athlete, and the target P. As shown in FIGS. 2A and 2B, the sight 4 has an elevation bar 11, a box 12, and a sight pin 6. The elevation bar 11 is fixed by means of a mounting shaft 5 extending forwards from the bow portion 1 such that the elevation bar 11 is positioned substantially along the vertical direction when shooting is performed with the bow portion 1 upright.

The box 12 is mounted to the elevation bar 11 so as to be slidable along the elevation bar 11. Arranged on the elevation bar 11 is a feed screw 13 elongated in the axial direction of the elevation bar 11. The feed screw 13 is threadedly engaged with the box 12 so that the box 12 can make fine movement along the elevation bar 11 through rotation of the feed screw 13.

The sight pin 6 is mounted to the box 12. The sight pin 6 is formed as a thin and narrow cylinder with a small circular section, and is mounted to the box 12 such that the axis of the pin is substantially aligned with the line connecting the eyes of the athlete and the target P when shooting is performed with the bow portion 1 upright. As shown in FIG. 1, in this condition, the athlete firmly holds the bow portion 1 such that the small circular section of the sight pin 6 is aimed at the target P, whereby it is always possible for the athlete to hold the bow portion 1 in the same condition.

In reality, however, the bow portion 1 cannot always be held perfectly in the same condition in the strict sense. Further, even if the bow portion 1 is held perfectly in the same condition in the strict sense, it can happen that, when the athlete shoots with the sight pin 6 of the sight 4 aimed at the target P, the arrow is off the mark depending upon the physical condition of the athlete, the weather, etc. In such cases, the box 12 is moved along the elevation bar 11 in accordance with the deviation amount to shift the position of the sight pin 6 and correct the previous shooting condition of the athlete. The athlete senses a difference between the shooting the target P with the sight pin 6 at the initial position and the shooting the target P with the position of the sight pin 6 shifted, and thereby can refer to it as information for correction for the next shooting.

In this way, the sight 4, which is a device used as a reference for the athlete when performing shooting next, is required to always exhibit highly accurate positional reproducibility. In particular, due to vibration or the like caused by the deformation of the bow portion 1, the box 12 is likely to be displaced with respect to the elevation bar 11. However, in the conventional sight 4, in which the box 12 is caused to slide along the elevation bar 11, it is necessary to perform dimensional processing on the box 12 and the elevation bar 11, with a gap for processing being maintained between the box 12 and the elevator bar 11. Further, in this processing, a dimensional tolerance is naturally required. As a result, between the box 12 and the elevation bar 11, in each dimension, there exists a gap caused by a tolerance required. This gap leads to rattling of the box 12 with respect to the elevation bar 11, and by extension, to a positional error of the box 12 with respect to the elevation bar 11. Such rattling is generated in both the horizontal and the vertical directions of the sections of the box 12 and the elevation bar 11. That is, though needed in terms of processing, this gap leads to rather poor reproduction performance for an archery-sight, resulting in rather poor usability for the athlete.

SUMMARY OF THE INVENTION

The purpose of the invention is provided to solve the above-mentioned problems.

Another purpose of the invention is to provide an archery sight mounted to a bow portion for archery, including: an elevation bar fixed to the bow portion and having a first sliding surface and a second sliding surface; a box mounted so as to be slidable along the first sliding surface and the second sliding surface of the elevation bar; an elastic member mounted to the box so as to be opposed to the first sliding surface; and a pressurizing means that pressurizes the elastic member in a direction at an angle with respect to the first sliding surface to deform the elastic member, the box being pressurized by the first sliding surface due to the elastic member and pressed against the second sliding surface.

Due to the above construction, it is possible to move the box while involving no play between itself and the elevation bar, with load being applied to the elevation bar.

DESCRIPTION OF THE PREFERRED EMBODIMENTS (Embodiment 1)

The embodiment 1 of the present invention will be described with reference to FIGS. 1 through 4.

Figure 1:
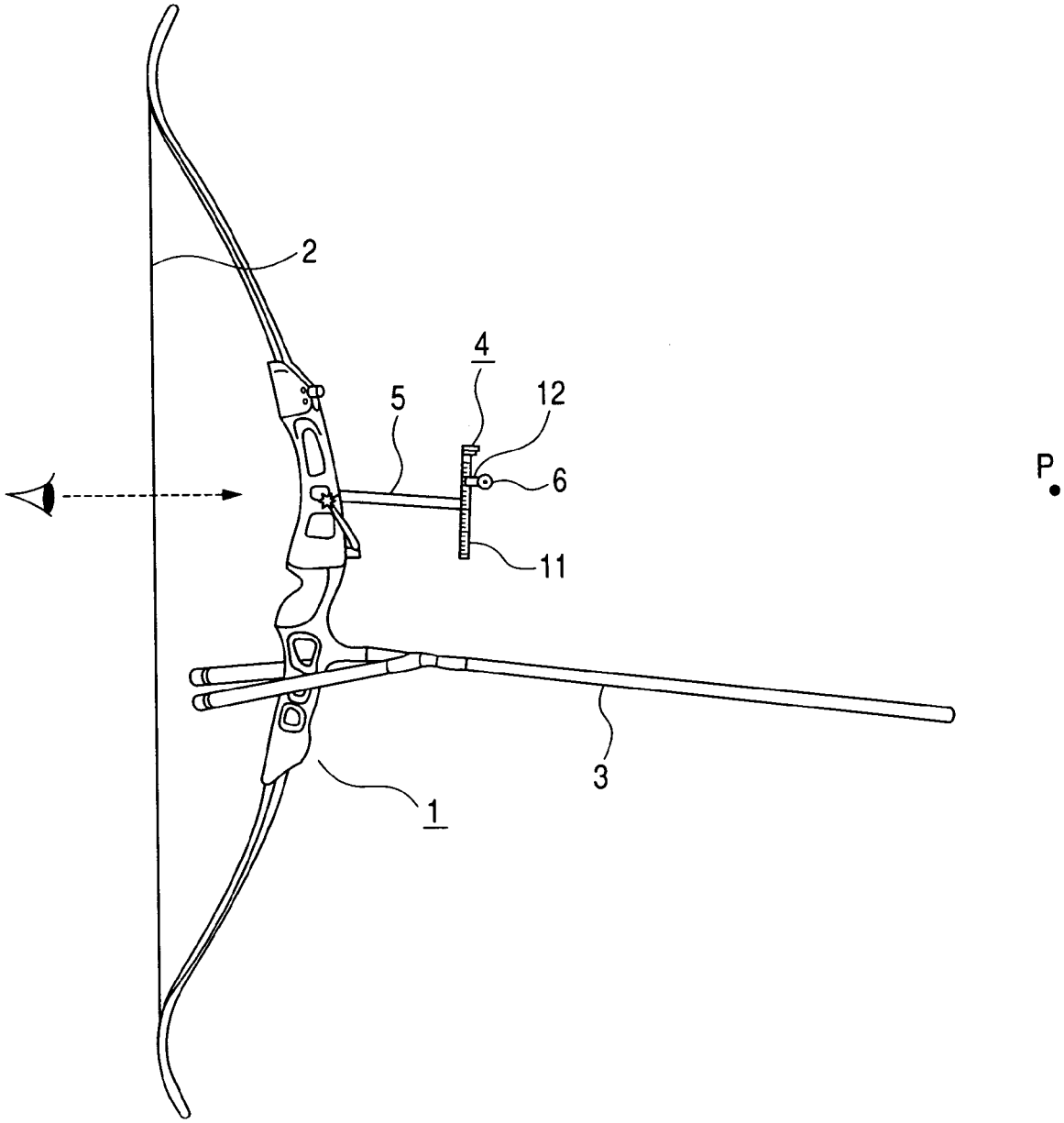
FIG. 1 is a general view of an archery bow.
Figure 2A:
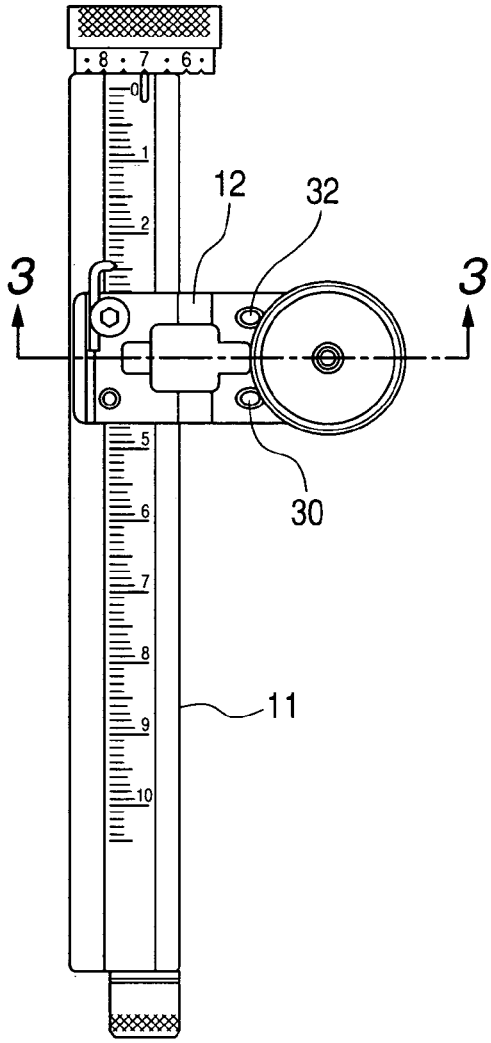
FIG. 2A is a side view of an archery-sight according to the present invention.
Figure 2B:
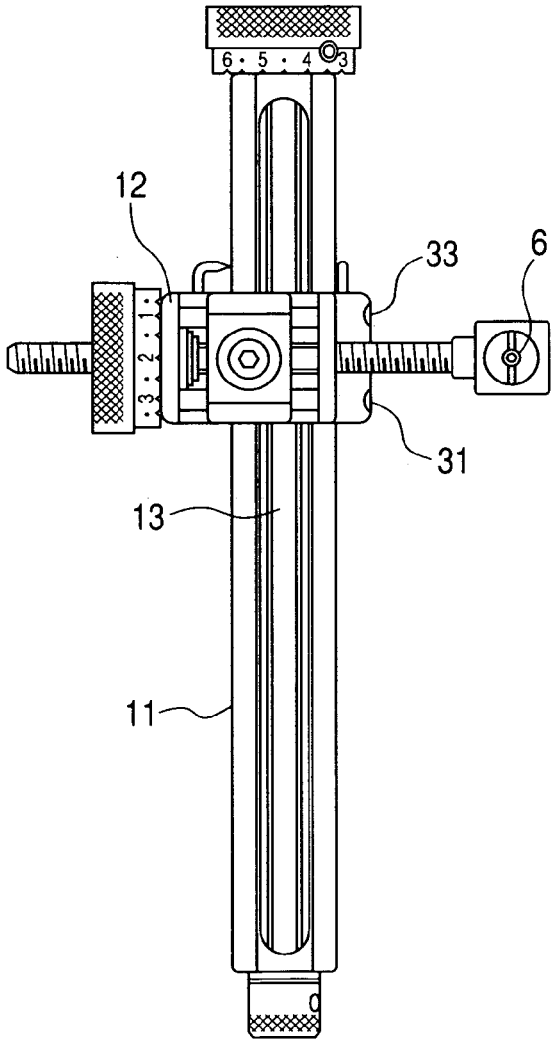
FIG. 2B is a front view of the archery-sight according to the present invention.

As shown in FIG. 1, the archery bow 1 has the bow portion 1 and the string 2. The operations of the bow portion 1 and the string 2 are as described above. The stabilizer 3 and the sight 4 are further mounted to the bow portion 1 so as to extend forwards from the bow portion 1. The operations of the stabilizer 3 and the sight 4 are also as described above. As shown in FIGS. 2A and 2B, the sight 4 includes an elevation bar 11, an box 12, and a sight pin 6. The elevation bar 11 is fixed with regard to the bow portion 1 by means of the extension 5 extending forwards so as to be substantially in the vertical position when a person shoots a bow with vertically positioning the bow portion 1.

As shown in FIGS. 2A and 2B, the box 12 is mounted to the elevation bar 11 so as to be capable of sliding along the elevation bar 11. Arranged on the elevation bar 11 is the feed screw 13 elongated in the axial direction of the elevation bar 11. The feed screw 13 is threadedly engaged with the box 12, enabling the box 12 to make fine movement along the elevation bar 11 through rotation of the feed screw 13. The sight pin 6 is mounted to the box 12. The function of the sight pin 6 is also the same as described above.

Figure 3:
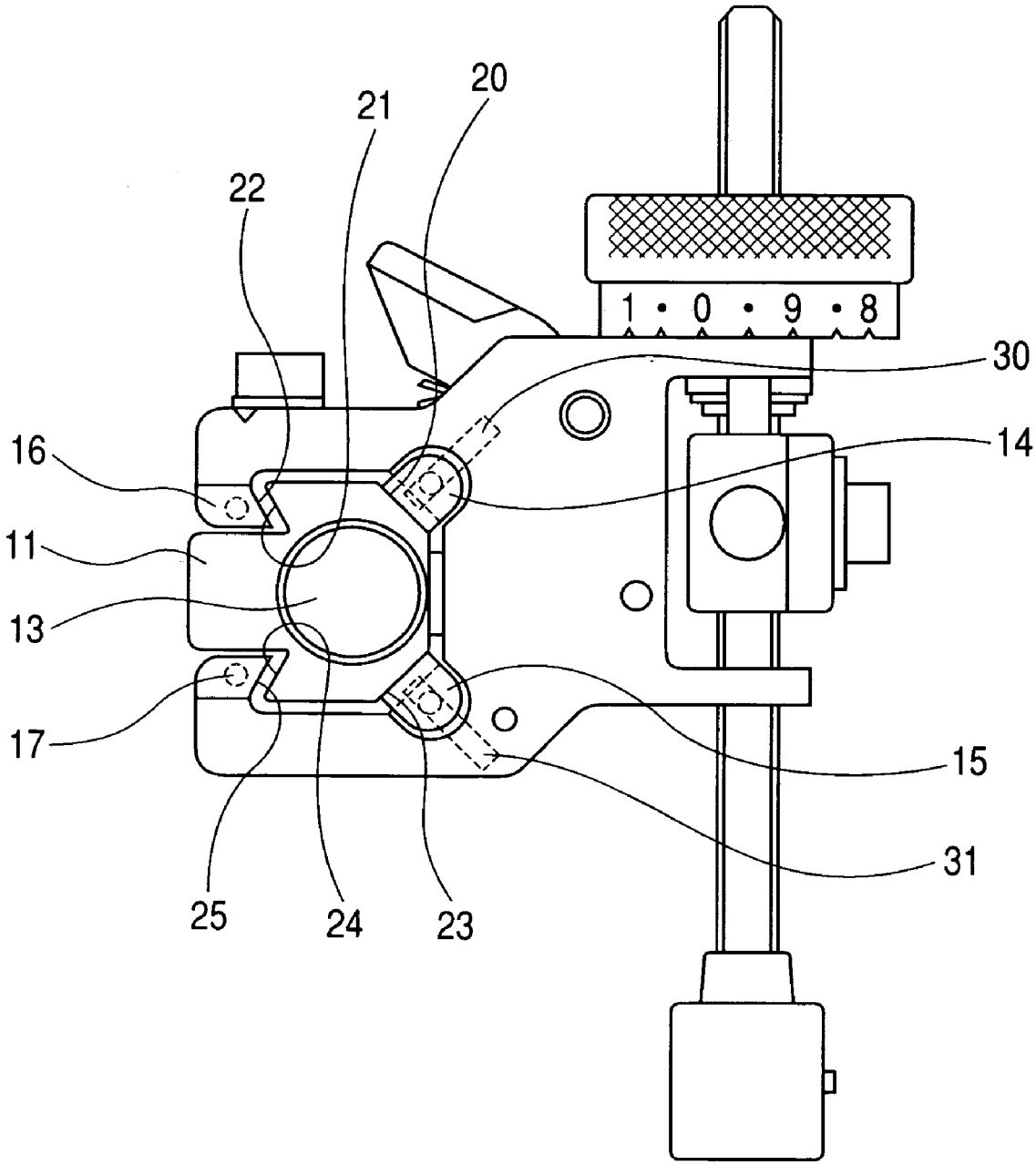
FIG. 3 is a sectional view of a sight according to a first embodiment of the present invention, mainly showing the box and the elevation bar thereof.

Subsequently, the portions featuring the present invention will be described with reference to FIGS. 2A, 2B, and 3 through 5. FIG. 3 is a sectional view taken along the line 3—3 of FIG. 2A.

The box 12 has is mounted to the elevation bar 11 so as to be slidable along the same. For example, the box 12 has a sectional configuration enclosing the elevation bar 11.

At the center of the elevation bar 11, there is arranged the feed screw 13 so as to extend in the sliding direction of the box 12, which corresponds to the longitudinal direction of the elevation bar 11. Preferably, the feed screw 13 is arranged substantially at the center of the elevation bar 11

The elevation bar 11 has a first sliding surface 20 and a fourth sliding surface 23 provided with an angle with respect to the first sliding surface. For example, the first and fourth sliding surfaces on the box 12 are provided on the main body side of the elevation bar 11. Respectively mounted to the portions of the box 12 corresponding to the first sliding surface 20 and the fourth sliding surface 23 are pressure plates 14 and 15, which are elastic members. The pressure plates 14 and 15 are formed of an elastic resin, typical examples of which include polyamide resin and polyacetal resin.

The pressure plates 14 and 15 are respectively arranged so as to be opposed to the first and fourth sliding surfaces 20 and 23, which means each of them has substantially the same angle as the first and fourth sliding surfaces 20 and 23.

Each of the pressure plates 14 and 15 is mounted to the box 12, with their both ends being fixed thereto. The box 12 is equipped with holes having screw portions each at an angle with respect to the pressure plates 14 and 15. Presser screws 30 and 31 as pressurizing means are respectively threadedly engaged with the holes having the screw holes. A plurality of holes having screw portions are arranged in the longitudinal direction of each of the pressure plates 14 and 15. Further, plural screws are threadedly engaged so as to be respectively in correspondence with the holes.

Figure 4:
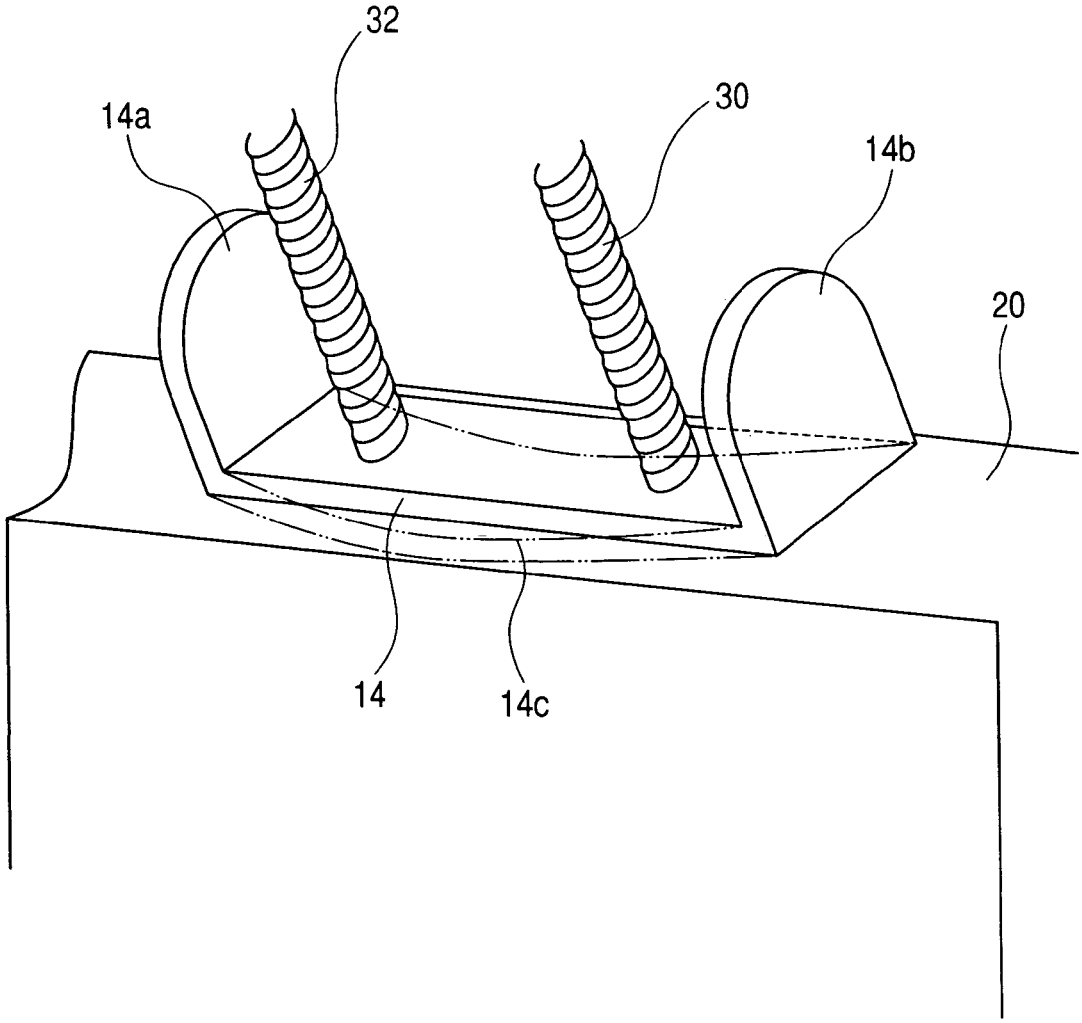
FIG. 4 is a schematic view of the sight according to the first embodiment of the present invention, showing the relationship between a first sliding surface, a pressure screw, and a pressure plate.

FIG. 4 shows the positional and operational relationship between the pressure plate 14, the first sliding surface 20, and the plurality of pressure screws 30 and 32 threadedly engaged with the holes having screw portions formed so as to be at an angle with respect to the pressure plate 14. While the drawing only shows the relationship between the pressure plate 14, the first sliding surface 20, and the pressure screws 30 and 32, the same applies to the relationship between the pressure plate 15, the fourth sliding surface 23, and the pressure screw 31, which are in plane symmetry therewith.

As shown in the drawing, the pressure plate 14 has at its ends tab portions 14*a* and 14*b* for mounting. The pressure plate 14 is fixed in position such that the tab portions 14*a* and 14*b* enter the end portions of the box 12. Thus, the pressure plate 14 is in a plate-beam-like state with their both ends fixed. Between the tab portions 14*a* and 14*b* at the ends of the pressure plate 14, there are arranged the pressure screws 30 and 32 serving as the pressurizing means. Although not shown in FIG. 4, the box 12 has holes having screw portions formed so as to be at an angle with respect to the pressure plate 14, and the pressure screws 30 and 32 are threadedly engaged with these holes as described above.

With the pressure plate 14 being fixed to the box 12 by means of the tab portions 14*a* and 14*b*, the lower surface of the pressure plate 14 is adjusted so as to constitute a surface 14*c* which is in contact with the first sliding surface 20 while being substantially parallel thereto. The positions of the end portions of the pressure screws 30 and 32 are adjusted such that, in the initial state, their forward ends abut the upper surface of the pressure plate 14, which is in contact with the first sliding surface 20. When they are further tightened, the pressure screws 30 and 32 go ahead along the holes by thread provided in the respective holes, until the forward ends of the pressure screws 30 and 32 protrude on the other side. The respective protruding forward ends of the pressure screws 30 and 32 gives pressure to the surface of the pressure plate 14 and deforms he pressure plate 14 so as to be shifted from the position of the surface 14*c* to the first sliding surface 20, which is in contact with the first sliding surface 20 while being substantially parallel thereto, to a defected position 14*d*, where it pressurizes the first sliding surface 20. That is, as a result of the respective forward end portions of the pressure screws 30 and 32 protruding, the pressure screws 30 and 32 as pressurizing means pressurizes the surface of the pressure plate 14 as the elastic member against the first sliding surface 20 with deforming the elastic member.

Figure 5:
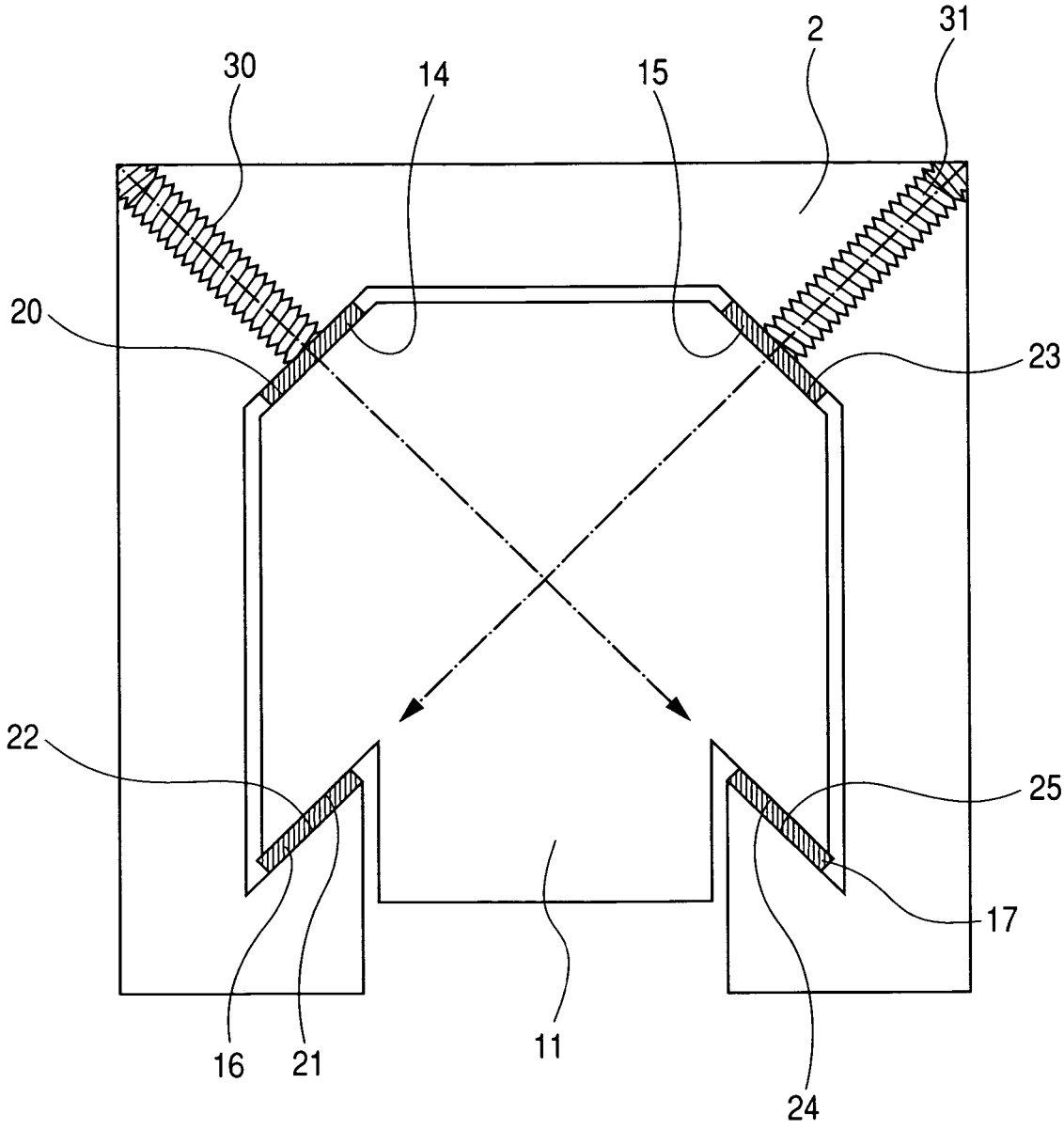
FIG. 5 is a sectional view of the sight according to the first embodiment of the present invention, showing in detail the load directions in the portion where the box and the elevation bar exist.

FIG. 5 schematically shows the relationship between the elevation bar 11 and the box 12 of FIG. 3. In the following, the relationship will be described in more detail with reference to FIGS. 3 and 5.

A second sliding surface 21 is arranged on the elevation bar 11 on the same side as the first sliding surface 20 as well as on the side opposite to the box 12, and a fifth sliding surface 24 is arranged on the elevation bar 11 on the same side as the fourth sliding surface 23 as well as on the side opposite to the box 12.

On the box 12 side, there are arranged at respective positions opposed to the second sliding surface 21 and the fifth sliding surface 24, receiving portions 22 and 25 constituting other elastic members. It is desirable for the receiving portions 22 and 25 to be formed of an elastic resin respectively. Typical examples of the resin include polyamide resin and polyacetal resin.

In this construction, when the surface of the pressure plate 14 deformed through pressurization due to the protrusion of the forward end portions of the pressure screws 30 and 32 pressurizes the box 12 through the intermediation of the first sliding surface 20, the box 12 is inclined to move in the pressurizing direction. At the same time, the forward end portions of the pressure screws 31 and 33 protrude, whereby the pressure plate 15 is pressurized to be deformed, and the deformed surface of the pressure plate 15 is pressed against the box 12 through the intermediation of the fourth sliding surface 23. As a result, there is no more clearance (gap) between the first sliding surface 20 and the pressure plate 14 and between the fourth sliding surface 23 and the pressure plate 15, respectively.

The first sliding surface 20 and the fourth sliding surface 23 provided with an angle to the first sliding surface 20 are respectively arranged on the box. The pressure plates 14 and 15 fixed thereto are also arranged at an angle, so that, as indicated by the arrows in FIG. 5, the pressurization by the pressure screws 30 and 31 presses the box against the sides respectively opposed to the pressure screws 30 and 31, that is, against the receiving portions 17 and 16, respectively.

Conversely, when viewed in terms of the horizontal and vertical components of the pressurization force by the pressure screws 30 and 31, arranged as shown in FIG. 5, the box 12 is to be pressed against the elevation bar 11 in both the horizontal and the vertical directions. As a result, due to the pressurization by the pressure screws 30 and 31, the pressure plates 14 and 15 are deformed to pressurize the first sliding surface 20 and the fourth sliding surface 23, and due to this pressurization exerted on the first sliding surface 20 and the fourth sliding surface 23, the elevation bar 11 makes a relative movement away from the box 12. Further, as a result, the second sliding surface 21 and the fifth sliding surface 24, arranged on the elevation bar 11 on the opposite sides of the first sliding surface 20 and the fourth sliding surface 23, are respectively pressurized so as to bring them into contact with the third sliding surface 22 and the sixth sliding surface 25 of the receiving portion 16. As a result, there is no more play between the second sliding surface 21 and the third sliding surface 22. Similarly, there is no more clearance between the fifth sliding surface 24 and the sixth sliding surface 25.

Pressurization is exerted in the horizontal direction in FIG. 5, with the first sliding surface 20 and the fourth sliding surface 23 being opposed to each other, so that the box 12 is fixed to the elevation bar 11 also in the horizontal direction.

Here, it is desirable for the first sliding surface 20 and the second sliding surface 21 to be parallel to each other. Further, it is also desirable for the fourth sliding surface 23 and the fifth sliding surface 24 to be parallel to each other. As will be illustrated with referent, for example, to the relationship between the pressure screw 30, the pressure plate 14, the first sliding surface 20, and the second sliding surface 21, of the pressurizing force of the pressure screw 30 causing deformation of the pressure plate 14, the vertical force component thereof as seen in FIG. 5 is transmitted to the first sliding surface 20, and at the same time, is transmitted more efficiently to the second sliding surface 21, which is substantially parallel to the first sliding surface 20.

In this way, by the screws serving as the pressurizing means, the box 12 is substantially fixed to the elevation bar 11, with practically no play left in the horizontal direction nor the vertical direction in the section thereof. It should be noted, however, that the pressure plates 14 and 15 and the receiving portions 16 and 17 are formed of elastic chemical resin, so that, even in the state in which the pressure plates 14 and 15 are deformed by the pressure screws 30, 31, 32, and 33 respectively serving as the pressurizing means and pressed against the first sliding surface 20, that is, even in the state in which fixation is substantially effected with practically no play in the horizontal direction nor the vertical direction, the box 12 can slide in the axial direction, which is the longitudinal direction of the elevation bar 11, along the first sliding surface 20 while involving no play.

That is, although due to the pressure plates 14 and 15 and the receiving portions 16 and 17 there is no gap between the box 12 and the elevation bar 11, and the box 12 is fixed in both the horizontal direction and the vertical direction in the section of the box 12 and the elevation bar 11, the box 12 can slide along the elevation bar 11. This helps to enhance the positional reproducibility of the sight pin 6 mounted to the box 12 with respect to the elevation bar 11.

It should be noted that, through adjustment of the amount by which the pressure screws 30 and 32 protrude, it is possible to adjust the force with which the pressure plate 14 pressurizes the first sliding surface 20. This makes it possible to adjust the frictional force between the pressure plate 14 and the first sliding surface 20, making it possible to adjust the manner in which the box 12 moves relative to the elevation bar 11. This also applies to the relationship between the pressure screws 31 and 33 and the pressure plate 15.

(Second Embodiment)

As described in the first embodiment, according to the present invention, there are mounted the pressure plates 14 and 15 consisting of elastic members at the portions of the box 12 respectively corresponding to the two surfaces; the first sliding surface 20 and the fourth sliding surface 23 arranged at an angle with respect to the first sliding surface 20, whereby the box 12 can move along the elevation bar 11 while fixed in both the horizontal direction and the vertical direction.

Figure 6:
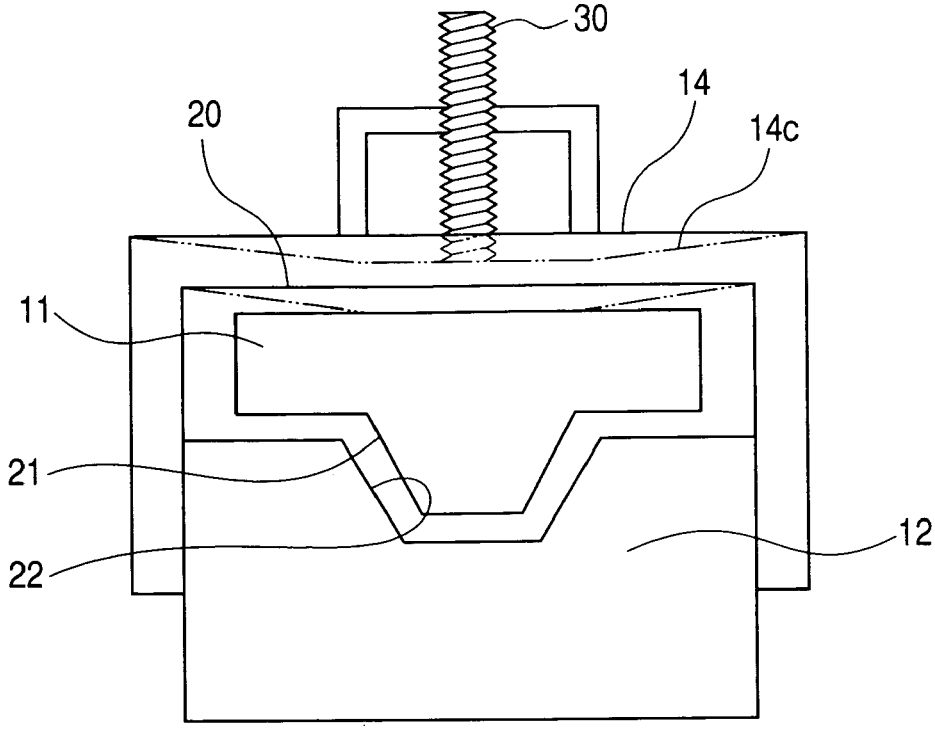
FIG. 6 is a diagram showing an example of a sight according to a second embodiment of the present invention.
Figure 7:
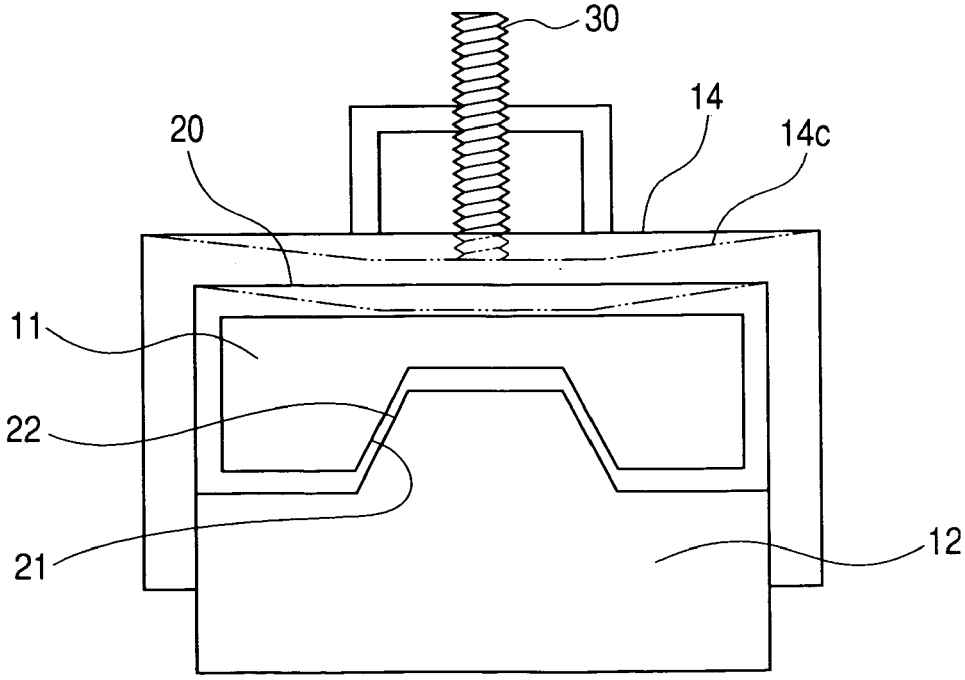
FIG. 7 is a diagram showing another example of the sight according to the second embodiment of the present invention.

However, as shown in FIG. 6 or 7, the same effect can also be achieved with a single set of components consisting of the first sliding surface 20, the pressure plate 14, and the pressure screw 30. In this case, the second sliding surface 21 is arranged on the surface of the elevation bar facing in the pressurizing direction of the pressure screw 30, opposed to the box 12 on the opposite side of the first sliding surface 20. And, the third sliding surface 22 is arranged on the portion of the box 12 corresponding to the second sliding surface 21. The third sliding surface 22 is formed of elastic resin. In this case, as shown in FIG. 6, a groove is provided in the box 12, with the third sliding surface 22 constituting a part of this groove. On the other hand, the elevation bar 11 has a protrusion with a sectional configuration corresponding to this groove, with the second sliding surface 21 constituting a part of this protrusion. Thus, even when the groove and the protrusion are engaged with each other and pressurization is effected from one direction, the effect is the same as that when fixation is effected in both the horizontal direction and the vertical direction in FIG. 6, with the box 12 being enabled to move along the elevation bar 11.

Further, while in the example shown in FIG. 6 the box 12 has a groove and the elevation bar 11 has a protrusion with a sectional configuration corresponding to the groove, this relationship may be reversed, as shown in FIG. 7.

That is, in the case of FIG. 7, the box 12 is equipped with a protrusion, and the third sliding surface 22 constitutes a part of this protrusion. On the other hand, the elevation bar 11 has a groove with a sectional configuration corresponding to this protrusion, with the second sliding surface 21 constituting a part of this groove. Thus, even when the groove and the protrusion are engaged with each other, and pressurization is effected from one direction, the same effect as that in the case of FIG. 6 is obtained.

What is claimed is:

1. A sight for archery, comprising:

an elevation bar fixed with respect to a bow portion, the elevation bar having a first sliding surface and a second sliding surface which is an opposite side surface to the first sliding surface;

a box having a third sliding surface opposed to the second surface, slidably provided along said elevation bar;

an elastic resin member configured to be opposed to the first sliding surface;

a screw engaged in a threaded portion threaded in said box, wherein an end of said screw contacts said elastic resin member and pushes the first sliding surface through said elastic resin member so that the second sliding surface is pushed onto the third sliding surface, and wherein said screw is capable of adjusting a force necessary to slide said box along said elevation bar.

2. A sight according to claim 1, wherein said elastic resin member is a plate-shaped member.

3. A sight according to claim 1, wherein a plurality of holes and a plurality of screws are provided between the ends of the elastic resin member.

4. A sight according to claim 2, wherein a plurality of screws respectively engaged in threaded portions threaded in said box are provided between the ends of said elastic resin member.

5. A sight according to claim 1, wherein one of the second sliding surface of said elevation bar and the third sliding surface of said box constitutes at least a part of a groove along the elevation bar, while the other of the second sliding surface of said elevation bar and the third sliding surface of said box constitutes a projection engageable with the part of the groove along said elevation bar.

6. A sight according to claim 2, wherein one of the second sliding surface of said elevation bar and the third sliding surface of said box constitutes at least a part of a groove along the elevation bar, while the other of the second sliding surface of said elevation bar and the third sliding surface of said box constitutes a projection engageable with the part of the groove along the elevation bar.

7. A sight according to claim 3, wherein one of the second sliding surface of said elevation bar and the third sliding surface of said box constitutes at least a part of a groove along the elevation bar, while the other of the second sliding surface of said elevation bar and the third sliding surface of said box constitutes a projection engageable with the part of the groove along the elevation bar.

8. A sight according to claim 1, wherein the third sliding surface is a part of a resin member.

9. A sight according to claim 2, wherein the third sliding surface is part of a resin member.

10. A sight according to claim 3, wherein the third sliding surface is part of a resin member.

11. A sight according to claim 4, wherein the third sliding surface is part of a resin member.

12. A sight according to claim 1, wherein said elevation bar further comprises a fourth sliding surface angled with respect to the first sliding surface, and a fifth sliding surface which is an opposite side surface to the fourth sliding surface, wherein said box has a sixth sliding surface opposing to the fifth sliding surface, wherein said sight comprises:

another elastic resin member configured to oppose to the fourth sliding surface, another screw engaged in another threaded portion threaded in said box, wherein an end of said another screw contacts said another elastic resin member and pushes the fourth sliding surface through said another elastic resin member so that the fifth sliding surface is pushed onto the sixth sliding surface, and wherein said screw and said another screw are capable of adjusting a force necessary to slide said box along said elevation bar.

13. A sight according to claim 2, wherein said elevation bar further comprises a fourth sliding surface angled with respect to the first sliding surface, and a fifth sliding surface which is an opposite side surface to the fourth sliding surface, wherein said box has a sixth sliding surface opposing to the fifth sliding surface, wherein said sight comprises;

another elastic resin member configured to oppose to the fourth sliding surface, another screw engaged in another threaded portion threaded in said box, wherein an end of said another screw contacts said another elastic resin member and pushes the fourth sliding surface through said another elastic resin member so that the fifth sliding surface is pushed onto the sixth sliding surface, and wherein said screw and said another screw are capable of adjusting a force necessary to slide said box along said elevation bar.

14. A sight according to claim 3, wherein said elevation bar further comprises a fourth sliding surface angled with respect to the first sliding surface, and a fifth sliding surface which is an opposite side surface to the fourth sliding surface, wherein said box has a sixth sliding surface opposing to the fifth sliding surface, wherein said sight comprises;

another elastic resin member configured to oppose to the fourth sliding surface, another screw engaged in another threaded portion threaded in said box, wherein an end of said another screw contacts said another elastic resin member and pushes the fourth sliding surface through said another elastic resin member so that the fifth sliding surface is pushed onto the sixth sliding surface, and wherein said screw and said another screw are capable of adjusting a force necessary to slide said box along said elevation bar.

15. A sight according to claim 4, wherein said elevation bar further comprises a fourth sliding surface angled with respect to the first sliding surface and a fifth sliding surface which is an opposite side surface to the first sliding surface, wherein said box has a sixth sliding surface opposing to the fifth sliding surface, wherein said sight comprises:

another elastic resin member configured to oppose to the fourth sliding surface, another screw engaged in another threaded portion threaded in said box, wherein an end of said another screw contacts said another elastic resin member and pushes the fourth sliding surface through said another elastic resin member so that the fifth sliding surface is pushed onto the sixth sliding surface, and wherein said screw and said another screw are capable of adjusting a force necessary to slide said box along said elevation bar.

16. A sight according to claim 5, wherein said elevation bar further comprises a fourth sliding surface angled with respect to the first sliding surface and a fifth sliding surface which is an opposite side surface to the first sliding surface, wherein said box has a sixth sliding surface opposing to the fifth sliding surface, wherein said sight comprises:

another elastic resin member configured to oppose to the fourth sliding surface, another screw engaged in another threaded portion threaded in said box, wherein an end of said another screw contacts said another elastic resin member and pushes the fourth sliding surface through said another elastic resin member so that the fifth sliding surface is pushed onto the sixth sliding surface, and wherein said screw and said another screw are capable of adjusting a force necessary to slide said box along said elevation bar.

17. A sight according to claim 16, wherein said another elastic resin member is a plate-shaped member.

18. A sight according to claim 16, wherein a plurality of screws respectively engaged in threaded portions threaded in said box are provided between the ends of said another elastic resin member.

19. A sight according to claim 17, wherein a plurality of holes and a plurality of screws are provided between the ends of said another elastic resin member.

20. A sight according to claim 16, wherein one of the fifth sliding surface of said elevation bar and the sixth sliding surface of said box constitutes at least a part of a groove along the elevation bar, while the other of the fifth sliding surface of said elevation bar and the sixth sliding surface of said box constitutes a projection engageable with the part of the groove along said elevation bar.

21. A sight according to claim 17, wherein one of the fifth sliding surface of said elevation bar and the sixth sliding surface of said box constitutes at least a part of a groove along the elevation bar, while the other of the fifth sliding surface of said elevation bar and the sixth sliding surface of said box constitutes a projection engageable with the part of the groove along said elevation bar.

22. A sight according to claim 18, wherein one of the fifth sliding surface of said elevation bar and the sixth sliding surface of said box constitutes at least a part of a groove along the elevation bar, while the other of the fifth sliding surface of said elevation bar and the sixth sliding surface of said box constitutes a projection engageable with the part of the groove along said elevation bar.

23. A sight according to claim 16, wherein the sixth sliding surface is a part of a resin member.

24. A sight according to claim 17, wherein the sixth sliding surface is a part of a resin member.

25. A sight according to claim 18, wherein the sixth sliding surface is a part of a resin member.

26. A sight according to claim 20, wherein the sixth sliding surface is a part of a resin member.

27. A sight for archery, comprising:

an elevation bar fixed with respect to a bow portion, the elevation bar having a first sliding surface and a second sliding surface which is an opposite side surface to the first sliding surface, a box having a third sliding surface opposed to the second surface, slidably provided along said elevation bar;

a plate-shaped elastic resin member configured to be opposed to the first sliding surface; and a screw engaged in a threaded portion threaded in said box, wherein an end of said screw contacts said elastic resin member and pushes the first sliding surface through said elastic resin member so that the second sliding surface is pushed onto the third sliding surface in a condition where said box is slidable along a longitudinal direction of said elevation bar, wherein said plate-shaped elastic resin member is fixed on said box at ends of said plate-shaped elastic resin member so that said plate-shaped elastic resin member deforms by adjusting an amount in which said screw is driven along the threaded portion, wherein said screw is capable of adjusting a frictional force between said elastic resin member and the first sliding surface and adjusting a force necessary to slide said box along said elevation bar by adjusting an amount in which said screw is driven along the threaded portion.

28. A sight according to claim 27, wherein said elevation bar further comprises a fourth sliding surface angled with respect to the first sliding surface, and a fifth sliding surface which is an opposite side surface to the fourth sliding surface, wherein said box has a sixth sliding surface opposing to the fifth sliding surface, wherein said sight comprises:

another plate-shaped elastic resin member configured to oppose to the fourth sliding surface, another screw engaged in another threaded portion threaded in said box, wherein an end of said another screw contacts said another plate-shaped elastic resin member and pushes the fourth sliding surface through said another plate-shaped elastic resin member so that the fifth sliding surface is pushed onto the sixth sliding surface wherein said another plate-shaped elastic resin member is fixed on said box at ends of said another plate-shaped elastic resin member so that said another plate-shaped elastic resin member deforms by adjusting an amount in which said another screw is driven along said another threaded portion, wherein said another screw is capable of adjusting a frictional force between said another plate-shaped elastic resin member and the fourth sliding surface and adjusting a force necessary to slide said box along said elevation bar by adjusting an amount in which said another screw is driven along said another threaded portion.

* * * * *